United States Patent [19]

Severijns et al.

[11] 3,978,682

[45] Sept. 7, 1976

[54] REFRIGERATION METHOD AND APPARATUS BY CONVERTING $^4$HE TO A SUPERFLUID

[75] Inventors: Adrianus Petrus Severijns; Frans Adrianus Staas, both of Eindhoven, Netherlands

[73] Assignee: U.S. Philips Corporation, New York, N.Y.

[22] Filed: Feb. 21, 1975

[21] Appl. No.: 551,636

[30] Foreign Application Priority Data

Mar. 1, 1974 Netherlands ..... 7402781

[52] U.S. Cl. ..... 62/113; 62/502; 62/514 R

[51] Int. Cl.$^2$ ..... F25B 41/00

[58] Field of Search ..... 62/113, 502, 514

[56] References Cited

UNITED STATES PATENTS

| | | | |
|---|---|---|---|
| 3,427,817 | 2/1969 | Rietdijk | 62/113 |
| 3,447,339 | 6/1969 | Rietdijk | 62/514 R |
| 3,678,704 | 7/1972 | Staas | 62/514 R |
| 3,713,305 | 1/1973 | Staas et al. | 62/514 R |

*Primary Examiner*—William F. O'Dea
*Assistant Examiner*—Ronald C. Capossela
*Attorney, Agent, or Firm*—Frank R. Trifari; J. David Dainow

[57] ABSTRACT

A refrigerator operable with an evaporation chamber and superfluid $^4$He II for temperatures below the λ-point of helium, and means for preventing the $^4$He II from creeping upward out of the evaporation chamber.

7 Claims, 2 Drawing Figures

REFRIGERATION METHOD AND APPARATUS BY CONVERTING $^4$HE TO A SUPERFLUID

BACKGROUND OF THE INVENTION

The invention relates to a refrigerator for temperatures below the λ-point of helium. A reservoir for liquid $^4$He I is connected, via a connection duct which successively includes, viewed from the reservoir, one side of a heat exchanger in which liquid $^4$He I is subjected to a temperature decrease, and a choke member in which the $^4$He is subjected to a pressure decrease, to an evaporation chamber for liquid $^4$He II. The evaporation chamber is provided with a discharge duct for $^4$He gas in which the other side of the heat exchanger is included. The invention furthermore relates to a method of generating temperatures below the λ-point of helium.

In a refrigerator of the kind which is the subject of the present invention and which is known from U.S. Pat. No. 3,427,817, the reservoir normally contains a $^4$He-bath of 4.2°K under atmospheric pressure. This liquid $^4$He in the normal phase ($^4$He I) is subjected to a temperature decrease in the heat exchanger and to a pressure decrease in the choke member, part of the liquid then evaporating. The remaining liquid reaches the evaporation chamber where heat is taken up from the object to be cooled. The temperature to which the object is cooled depends on the pressure in the evaporation chamber. The lower the pressure is, the lower the temperature will be. Via the discharge duct, the evaporation chamber is pumped down to a low pressure by a pumping device.

An advantage of the known refrigerator is that it can operate without interruption for a prolonged period of time, in that it is possible to supply $^4$He continuously from the reservoir to the evaporation chamber. However, if cooling temperatures below the λ-point of helium (2.18°K) are to be realized (for example, for condensing concentrated $^3$He in $^3$He-$^4$He dilution refrigerators or for cooling masers, computer stores, susperconductive coils, paramagnetic salts etc,), problems arise, so that the known refrigerator cannot be used at all or only with great difficulty.

The cause of these problems lies in the fact that when liquid He II, having its superfluid properties, is present in the evaporation chamber ($^4$He below 2.18°K), this He II creeps upwards as a thin film on the wall of the chamber, through the choke member to the region of higher temperature. This flowback of helium occurs in spite of the opposing force of gravity and in spite of the opposing force caused by the higher pressure level on the inlet side of the choke member. As a result, He II cannot be permanently stored in the evaporation chamber, so that the operation of the refrigerator is disturbed.

SUMMARY OF THE INVENTION

The present invention has for its object to provide a refrigerator which, by a simple improvement of the known device, is particularly suitable for cooling temperatures below the λ-point of helium.

In order to realize this object, the new refrigerator is characterized in that in the connection duct between the heat exchanger and the choke member, an auxiliary reservoir is included, a readily heat-exchanging connection being provided between the evaporation chamber and the auxiliary such that liquid $^4$He in the auxiliary reservoir is cooled below the λ-point by $^4$He II in the evaporation chamber.

It is thus achieved that the temperature on the inlet side of the choke member, in the auxiliary reservoir, is equal or substantially equal to the temperature on the outlet side of the choke member, in the evaporation chamber. He II in the evaporation chamber then substantially no longer tends to flow back to He II in the auxiliary reservoir. In as far as there still is a flow-back effect, this is amply compensated for by the pumping force due to the higher pressure of the He II in the auxiliary reservoir, possibly assisted by the force of gravity.

In a preferred embodiment of the refrigerator according to the invention, the auxiliary reservoir and the evaporation chamber are assembled to form one unit and are separated from each other by a heat-exchanging partition in which a bore is provided as a choke opening. This not only offers the advantage of a compact construction, but at the same time good use is directly made of the cold produced in the choke opening for cooling the auxiliary reservoir.

In a further preferred embodiment of the refrigerator according to the invention, there is provided a valve body which cooperates with the choke opening and which is connected to a control member by way of a valve rod which is passed through a boundary wall of the auxiliary reservoir. This offers the advantage of remote control of the effective cross-sectional area of the choke opening, in accordance with the operating circumstances. If the device is out of operation, the choke opening can thus be completely closed.

A further preferred embodiment of the refrigerator according to the invention is characterized in that the auxiliary reservoir comprises a boundary wall which is formed by a bellows which is arranged coaxially with respect to the valve rod and which is connected on the one side to the heat-exchanging partition and on the other side to the valve rod. Leakage or creep of He II along the valve rod to zones of higher temperature is thus simply prevented.

Differences in viscosity exist between the He I on its way from the reservoir to the auxiliary reservoir and the He II in the auxiliary reservoir which tends to flow in the direction of the reservoir which is at a higher temperature. These differences in viscosity cause flow instabilities due to local variations in the flow resistance. The $^4$He flow from the reservoir to the auxiliary reservoir is thus subject to variations, so that a continuously constant $^4$He supply to the auxiliary reservoir is not ensured.

Furthermore, as is known, He II has excellent heat conductivity. Consequently, and because of the tendency to flow to the reservoir, the He II in the auxiliary reservoir tends to disturb the temperature gradient prevailing between the reservoir and the auxiliary reservoir. This has an adverse effect on the thermal efficiency of the device.

In order to eliminate these drawbacks, a further preferred embodiment of the refrigerator according to the invention is characterized in that in the connection duct between the heat exchanger and the auxiliary reservoir a flow resistance element is included for stabilizing the $^4$He flow from the reservoir to the auxiliary reservoir during operation.

The flow resistance element ensures that the phase transient from He I to He II is fixed at a permanent location in the connection duct at a distance from the reservoir. The $^4$He flow through the connection duct is then stabilized, while proper thermal efficiency is obtained in that notably the temperature gradient across the heat exchanger is maintained. The flow resistance element preferably consists of a capillary tube in view of its simplicity.

The invention will be described in detail hereinafter with reference to the drawings which diagrammatically show (not to scale) two embodiments of the refrigerator by way of example.

DETAILED DESCRIPTION OF THE PREFERRED EMBODIMENTS

Figure 1:
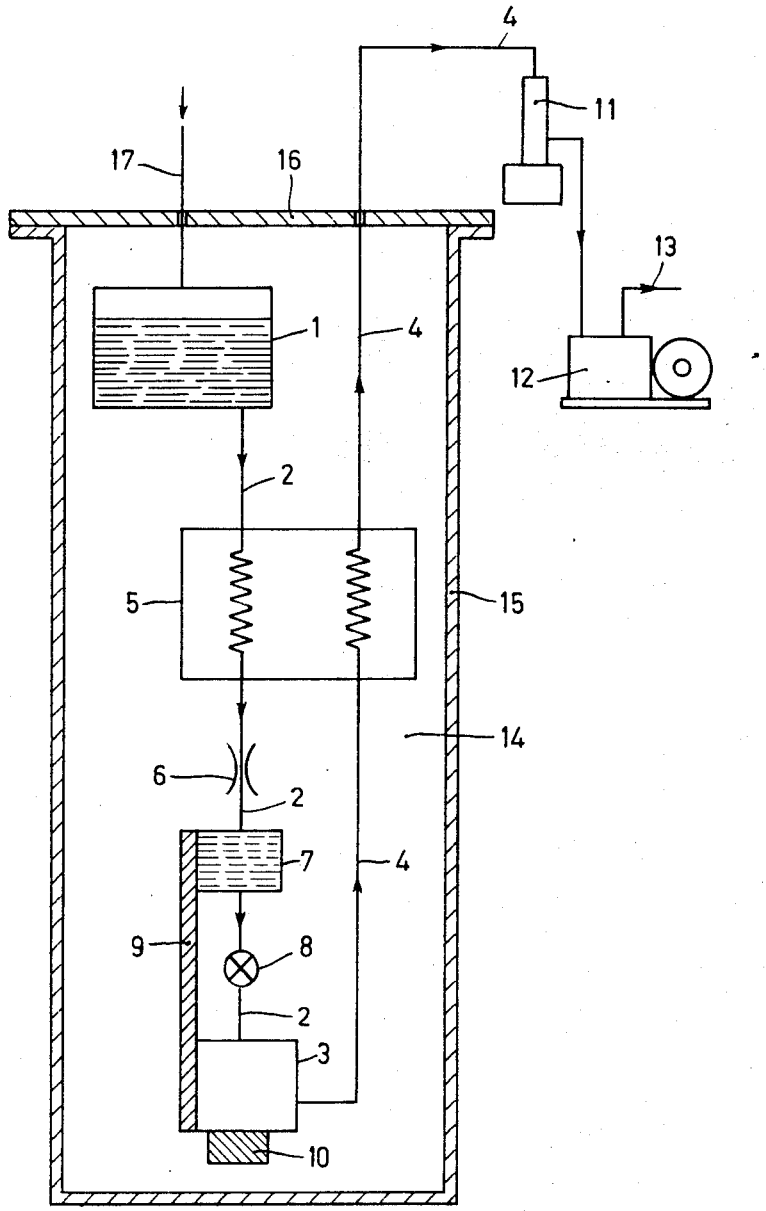
FIG. 1 is a longitudinal sectional view of an embodiment of the refrigerator.

The reference 1 in FIG. 1 denotes a reservoir for liquid $^4$He which communicates, by way of a connection duct 2, with an evaporation chamber 3 which has a discharge duct 4 connected thereto. A heat exchanger 5 is included on the one side in the connection duct 2, and on the other side in the discharge duct 4.

Connection duct 2 furthermore comprises a flow resistance element 6, an auxiliary reservoir 7 and a choke member 8. Auxiliary reservoir 7 is in good thermal contact with evaporation chamber 3 via a connection 9 of heat conductive material, for example, copper. Evaporation chamber 3 is in good thermal contact with an object 10 to be cooled. Discharge duct 4 has connected thereto a pumping system consisting of diffusion pump 11 and rotation pump 12 and comprising an oulet 13.

The part of the refrigerator which is at a lower temperature during operation is arranged in an evacuated space 14 inside a Dewar vessel 15 comprising a lid 16. Dewar vessel 15 is cooled, in a manner not shown but known, within a system of further Dewar vessels filled with liquid helium and nitrogen, respectively. Reservoir 1 can be filled via filling duct 17. During operation, reservoir 1 contains liquid $^4$He under atmospheric pressure (temperature 4.2°K). This $^4$He is cooled in heat exchanger 5 by low-pressure helium gas originating from the evaporation chamber 3, with the result that the temperature thereof decreases. The $^4$He remains in the normal, liquid $^4$He I phase.

From heat exchanger 5 the $^4$He I flows, via flow resistance element 6, to auxiliary reservoir 7 where the $^4$He I undergoes a phase transition to $^4$He II, having superfluid properties, due to the cooling below the λ-point by superfluid $^4$He II in evaporation chamber 3 via the properly heat conductive connection 9. Flow resistance element 6 ensures that the phase transition from $^4$He I to $^4$He II adjusts itself to a fixed location within this element or within the portion of the connection duct 2 which is situated between flow resistance element 6 and auxiliary reservoir 7. On the one hand, a stable constant $^4$He flow from reservoir 1 to auxiliary reservoir 7 is thus ensured, while on the other hand the heat exchanger 5 is not disturbed by the phase transition. This is because a superfluid $^4$He film in the heat exchanger 5 would have an adverse effect on the temperature gradient across this heat exchanger and hence on the thermal efficiency.

The $^4$He II in auxiliary reservoir 7 flows to choke member 8 and is subjected to a pressure decrease therein. This is accompanied by the production of cold, part of the $^4$He II then being evaporated. The remainder of the liquid $^4$He II evaporates in evaporation chamber 3 while taking up heat from the object 10 to be cooled. The cold low-pressure $^4$He gas is drawn off by pumping system 11, 12 via discharge duct 14, while taking up heat in heat exchanger 5, and leaves the device via discharge 13. The drawn-off $^4$He gas is normally not discharged to the surroundings, but is stored in a storage reservoir for later use or is fed directly to a liquefaction system.

Figure 2:
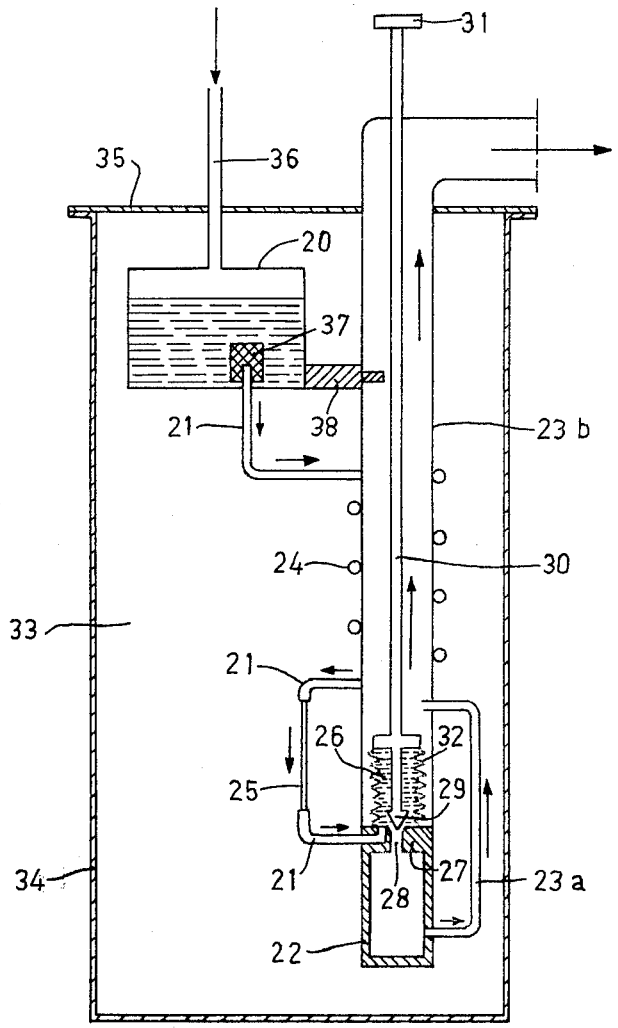
FIG. 2 is a longitudinal sectional view of a further embodiment of the refrigerator.

The device shown in FIG. 2 comprises a reservoir for liquid $^4$He II, denoted by the reference 20, which communicates, via a connection duct 21, with an evaporation chamber 22 having connected thereto a discharge duct consisting of a portion **23*a*, the upper end of which opens into a portion 23*b* having a larger diameter. Portion 23*a***, having the smaller diameter, constitutes a construction which limits the upward flow of a $^4$He II film.

A coil 24, included in the connection duct 21 and arranged about part of discharge duct portion **23*b*, constitutes, in conjunction with the latter portion, a heat exchanger in which $^4$He I flowing through coil 24** can exchange heat with cold low-pressure helium gas flowing through the discharge duct.

A capillary tube 25 is provided in the connection duct 21 as the flow resistance element. Evaporation chamber 22 and auxiliary reservoir 26 together constitute one assembly. Present therebetween is a substantially heat conductive wall 27 (for example, a copper or thin stainless steel wall) in which a choke opening 28 is provided. Choke opening 28 can be fully or partly released by a valve body 29 which is connected, via a valve rod 30, to an external control member 31. Valve rod 30 is passed through the auxiliary reservoir 26 and through discharge duct portion **23*b*. Auxiliary reservoir 26 comprises a boundary wall formed by a bellows 32 which is coaxially arranged about valve rod 30 and which is connected on the one side to the partition 27 and on the other side to the valve rod 30**.

The lower temperature section of the device is arranged in an evacuated space 33 which is bounded by a housing 34 and a lid 35 which are cooled in a manner not shown. A filling duct 36 for reservoir 20 and the discharge duct portion **23*b*, connected to a pump system not shown, are passed through the lid 35**.

A filter 37 for intercepting impurities is arranged in reservoir 20 in front of the inlet of connection duct 21. Reservoir 20 is in good thermal contact, via a block 38 of substantially heat conductive material, with the discharged, comparatively cold $^4$He gas flowing through discharge duct portion **23*b***.

The operation of the device is roughly the same as that of the device shown in FIG. 1. By means of control member 31, the choke opening 28 can be adjusted during operation and be closed when the device is not in operation. Bellows 32 then moves along with the valve body and ensures hermetical sealing of auxiliary reservoir 26. The cold generated in choke opening 28 by the pressure reduction directly contributes, via partition 27, to the cooling of the $^4$He in the auxiliary reservoir 26.

In using a device as shown in FIG. 2 and only one rotation pump, temperatures below 1°K were reached. It was found that said temperatures could be maintained for an indefinite period of time.

The embodiments shown are, of course, not limited. Within the scope of the invention, numerous variations are feasible including use of a ball valve as the choke member.

What is claimed is:

1. In a refrigerator operable at temperatures below the λ-point of helium, including a reservoir for containing liquid $^4$He I, a heat exchanger for further cooling said liquid $^4$He I, a choke member with inlet and outlet means for reducing the pressure of said further cooled liquid, an evaporation chamber for converting at least part of said further cooled $^4$He I to superfluid $^4$He II at a temperature below the λ-point thereof, and duct means for flowing said helium sequentially through said elements, the improvement in combination therewith comprising an auxiliary reservoir intermediate said choke member outlet and said evaporation chamber, and a highly heat-conductive element interconnecting and forming a heat-conductive assembly of said evaporation chamber and said auxiliary reservoir, whereby liquid $^4$He in said auxiliary reservoir is cooled to below the λ-point by $^4$He II in the evaporation chamber, and the choke inlet and outlet means are at substantially the same temperature, for preventing flow-back of said $^4$He II from said evaporation chamber to said auxiliary reservoir.

2. Apparatus acording to claim 1 wherein a portion of said heat-conductive element defines an aperture therethrough, and said choke member comprises said portion of said element.

3. Apparatus according to claim 2 wherein said choke member further comprises a movable valve body for variably closing said aperture, and means for moving said valve body.

4. Apparatus according to claim 3 wherein said auxiliary reservoir comprises a bellows engaged by said valve body, whereby movement of the valve body to open said aperture enlarges the cavity within said bellows.

5. Apparatus according to claim 1 further comprising restriction means for resisting the flow of liquid $^4$He from the reservoir to the auxiliary reservoir, for stabilizing said flow.

6. Apparatus according to claim 5 wherein said restriction means comprises a capillary tube.

7. In a refrigerator using liquid $^4$He I to refrigerate to temperatures below the λ-point of helium, the refrigeration method including containing a quantity of liquid $^4$He I, further cooling said liquid $^4$He I, reducing said further cooled $^4$He I to a lower pressure with a choke means, and converting at least a portion of said lower pressure $^4$He I in an evaporation chamber to superfluid $^4$He II at temperatures below the λ-point of helium, the improvement in combination therewith comprising the further steps of collecting said further cooled $^4$He I in an auxiliary reservoir before reducing the pressure thereof, and engaging said auxiliary reservoir and evaporation chamber in highly heat-conductive relationship, for cooling $^4$He I in said auxiliary reservoir to temperatures below the λ-point, and for maintaining the temperature upstream and downstream of the choke means substantially the same.

* * * * *